US009330822B2

(12) United States Patent
Nakatsu et al.

(10) Patent No.: US 9,330,822 B2
(45) Date of Patent: May 3, 2016

(54) REACTOR AND MANUFACTURING METHOD THEREOF

(71) Applicant: Tamura Corporation, Tokyo (JP)

(72) Inventors: Ryo Nakatsu, Saitama (JP); Toshikazu Ninomiya, Saitama (JP); Kotaro Suzuki, Saitama (JP); Tsutomu Hamada, Saitama (JP)

(73) Assignee: TAMURA CORPORATION, Tokyo (JP)

( * ) Notice: Subject to any disclaimer, the term of this patent is extended or adjusted under 35 U.S.C. 154(b) by 0 days.

(21) Appl. No.: 13/829,627

(22) Filed: Mar. 14, 2013

(65) Prior Publication Data

US 2013/0241686 A1 Sep. 19, 2013

(30) Foreign Application Priority Data

Mar. 15, 2012 (JP) ..... 2012-058584

(51) Int. Cl.

| | |
|---|---|
| ***H01F 27/24*** | (2006.01) |
| ***H01F 27/28*** | (2006.01) |
| ***H01F 3/00*** | (2006.01) |
| ***H01F 41/02*** | (2006.01) |
| ***H01F 27/26*** | (2006.01) |
| *H01F 3/14* | (2006.01) |

(52) U.S. Cl.

CPC ..... *H01F 3/00* (2013.01); *H01F 27/26* (2013.01); *H01F 41/0246* (2013.01); *H01F 3/14* (2013.01); *Y10T 29/49073* (2015.01)

(58) Field of Classification Search

CPC ..... H01F 3/10; H01F 3/14; H01F 27/263; H01F 27/306; H01F 37/00; H01F 3/00; H01F 27/26; H01F 41/0246; Y10T 29/49073

USPC ..... 336/212, 214, 182, 184

See application file for complete search history.

(56) References Cited

U.S. PATENT DOCUMENTS

| | | | | |
|---|---|---|---|---|
| 6,771,157 | B2 * | 8/2004 | Nishikawa et al. | 336/178 |
| 8,427,271 | B2 * | 4/2013 | Nakatsu et al. | 336/212 |
| 8,730,000 | B2 * | 5/2014 | Suzuki et al. | 336/212 |
| 8,922,323 | B2 * | 12/2014 | Uozumi et al. | 336/212 |

(Continued)

FOREIGN PATENT DOCUMENTS

| | | |
|---|---|---|
| JP | 2004-327479 | 11/2004 |
| JP | 2008-166502 | 7/2008 |

(Continued)

OTHER PUBLICATIONS

Office Action dated Jan. 13, 2016 for corresponding Japan Patent Application No. 2012-058584 with English Language Translation (6 pages).

*Primary Examiner* — Mangtin Lian
*Assistant Examiner* — Kazi Hossain

(57) ABSTRACT

A reactor includes a coil and a core unit having partial cores butted against one another to form a closed magnetic path. The partial cores include a first partial core forming and a second partial core. The first partial core is inserted in the hollow of the coil. A pressed face of the first partial core is oriented orthogonal to the winding axis direction of the coil. The second partial core is butted against the first partial core. A pressed face of the second partial core is oriented orthogonal to a direction different from the winding axis direction. The pressed face of the second partial core is a substantially flat plane.

11 Claims, 9 Drawing Sheets

(56) References Cited

U.S. PATENT DOCUMENTS

| | | | | |
|---|---|---|---|---|
| 2008/0169769 | A1* | 7/2008 | Lee | 315/278 |
| 2009/0027151 | A1* | 1/2009 | Nakatsu et al. | 336/212 |
| 2009/0108971 | A1* | 4/2009 | Okamoto | 336/65 |
| 2011/0025444 | A1* | 2/2011 | Sugiyama et al. | 336/212 |
| 2011/0279210 | A1* | 11/2011 | Ono | 336/192 |
| 2012/0092120 | A1* | 4/2012 | Yoshikawa et al. | 336/220 |
| 2012/0206232 | A1* | 8/2012 | Yamamoto et al. | 336/210 |

FOREIGN PATENT DOCUMENTS

| | | |
|---|---|---|
| JP | 2009296015 | 12/2009 |
| JP | 4465635 | 3/2010 |

* cited by examiner

REACTOR AND MANUFACTURING METHOD THEREOF

CROSS-REFERENCE TO RELATED APPLICATIONS

This application is based upon and claims the benefit of priority from Japanese Patent Application NO. 2012-058584, filed on Mar. 15, 2012; the entire contents of which are incorporated herein by reference.

FIELD OF THE INVENTION

The present invention relates to a reactor having a core that forms a closed magnetic path, and a manufacturing method of the same.

DESCRIPTION OF THE RELATED ART

Reactors are utilized in various applications, such as drive systems, etc., of a hybrid vehicle and an electric vehicle. Japan Patent No. 4465635 and JP 2009-296015 A disclose a specific structure of a reactor of this kind. The reactor disclosed in Japan Patent No. 4465635 and JP 2009-296015 A includes a pair of coils disposed side by side in a parallel manner, and a plurality of I-shaped cores are inserted in the hollow core part of each coil and arranged side by side. Moreover, such a reactor includes a pair of U-shaped cores disposed in such a way that respective pairs of the leg portions face with each other. The I-shaped core groups are disposed between the facing leg portions, thereby forming a substantially annular closed magnetic path having each core body serving as a magnetic path. According to the reactor of this kind, a large current is superimposed, and thus each core body forming the closed magnetic path is typically formed of a powder magnetic core.

As disclosed in Japan Patent No. 4465635, magnetic powders are poured in a cavity defined by right and left fixed dies and top and bottom movable dies, and the poured magnetic powders are compressed and pressed by the top and bottom movable dies that can move relative to each other, thereby molding a core. In the core molded in this manner, there remains burrs, which are unnecessary objects mainly running in a direction orthogonal to a pressed face, on the pressed face (a surface pressed by the movable dies) of the core. The burr of this kinds may damage an insulation layer of the coil, and thus such burr is eliminated after the pressing. When the burr is not eliminated, the I-shaped core is designed to have a small cross-sectional area so that a necessary clearance for avoiding such burr is formed relative to the hollow core part of the coil when the I-shaped core is inserted in the hollow core part of the coil. According to such a design, however, reduction of the cross-sectional area of the I-shaped core may decrease the inductance. In order to maintain the dimension of the cross-sectional area of the I-shaped core and to suppress a reduction of the inductance, it is necessary to design a large hollow core part to ensure a clearance with the I-shaped core. However, such a design results in the increase of the dimension of the coil since the hollow is enlarged.

In JP 2009-296015 A, the I-shaped core is inserted in and disposed at the hollow core part in such a way that the pressed face is oriented orthogonal to the winding axis of the coil, and thus the burrs left on the pressed face mainly run in the winding axis direction. Hence, according to the reactor disclosed in JP 2009-296015 A, it is unnecessary to design a clearance for avoiding burr between the I-shaped core and the hollow core part. Moreover, the U-shaped core is disposed in such a way that the pressed face is directed orthogonal to the winding axis direction of the coil so as to match the I-shaped core, in other words, the U-shaped core is compressed and pressed by the pair of movable dies that can move relative to each other in the lengthwise direction of the core leg portion. In this case, the thickness of the powder compact pressed between the pair of movable dies largely differs at each leg portion and at a portion interconnecting the leg portions with each other. That is to say, the powder compact has a large step portion in the thickness direction. Accordingly, the die for multi-stage molding that is complicated and expensive must be used. However, it is desirable that the U-shaped core should be formed by a pressing using a die employing a structure as simple as possible in order to avoid the increase of costs (e.g., initial costs and maintenance costs for the die).

The present invention has been made in view of the above-explained circumstances, and it is an object of the present invention to provide a reactor and a manufacturing method thereof which eliminate a necessity of designing a clearance for avoiding burr between a core hollowpart and a partial core, and which enables a press-molding of the partial core by a die employing a structure as simple as possible.

SUMMARY OF THE INVENTION

A reactor according to an aspect of the invention includes a coil and a core unit including a plurality of partial cores butted one another to form a closed magnetic path and partially inserted and disposed in a hollow core part of the coil. The plurality of partial cores include a first partial core which forms a magnetic path passing through the hollow core part of the coil and a second partial core which forms a magnetic path passing through an exterior of the hollow core part of the coil. The first partial core is inserted and disposed in the hollow core part of the coil such that a pressed face of the first partial core is oriented orthogonal to a winding axis direction of the coil. The second partial core is butted against the first partial core and disposed such that a pressed face of the second partial core is oriented orthogonal to a certain direction which is different from the winding axis direction. The pressed face of the second partial core is a substantially flat plane.

According to an aspect of the present invention, the first partial core is inserted and disposed in the hollow core part of the coil with the remaining burr being mainly directed in the winding axis direction. Hence, it is unnecessary to provide a clearance between the first partial core and the hollow core part of the coil for avoiding the burr contacting the coil. Moreover, the second partial core is pressed in a direction which is inconsistent with the press direction of the first partial core, makes the thickness of the powder compact uniform at the time of press-molding and substantially has no step portion so that the pressed face becomes a substantially flat plane. Hence, according to an aspect of the present invention, the cross-sectional area of the first partial core can be made larger so as to increase the inductance, and the second partial core can be pressed and shaped by a die with a further simple structure.

According to an aspect of the present invention, the certain direction is, for example, a direction orthogonal to the winding axis direction. In this case, the pressed face of the second partial core is disposed in a direction orthogonal to the pressed face of the first partial core.

For example, the first partial core includes a first magnetic path end face orthogonal to the winding axis direction, and the second partial, core includes a second magnetic path end face orthogonal to the winding axis direction. The first magnetic path end face and the second magnetic path end face are disposed so as to face with each other, and have different area sizes from each other.

More specifically, the second magnetic path end face may have a smaller area size than the area size of the first magnetic path end face, and has a smaller dimension than the first magnetic path end face in a direction orthogonal to the pressed face of the second partial core.

Moreover, the first magnetic path end face and the second magnetic path end face may be disposed in the hollow core part of the coil so as to face with each other with a first gap therebetween.

According to an aspect of the present invention, a cross-sectional shape of the first partial core orthogonal to the winding axis direction may be substantially similar to a cross-sectional shape of the hollow core part of the coil orthogonal to the winding axis direction.

The reactor according to an aspect of the present invention may include a pair of coils disposed side by side in a parallel manner. In this case, the core unit may include at least a pair of I-shaped cores each inserted and disposed in the hollow core part of each of the pair of coils and a pair of U-shaped cores each including a first leg portion and second leg portion disposed in parallel with each other, and being disposed in such a way that the respective first leg portions and the respective second leg portions face with each other. The respective first leg portions of the pair of U-shaped cores and the respective second leg portions thereof may be disposed so as to be butted with each other through the I-shaped core inserted and disposed in the hollow core part of the coil to form a substantially annular closed magnetic path. In this case, the I-shaped core is the first partial core, and the U-shaped core is the second partial core.

The I-shaped core may include a plurality of I-shaped cores inserted in the hollow core part of each coil and disposed side by side in the winding axis direction.

Moreover, second gaps may be present between the adjoining I-shaped cores.

According to an aspect of the present invention, all of the first gaps and the second gaps are disposed in the hollow core part of the coil.

According to an aspect of the present invention, the pressed face of the second partial core is, for example, provided with a step portion across a whole edge of the pressed face of which height is equal to or smaller than 1 mm.

According to another aspect of the present invention, a method of manufacturing a reactor including a plurality of partial cores that form a closed magnetic path is provided.

The method includes steps of:

(a) a first partial core shaping step

A material is pressed to shape a first partial core that forms a magnetic path passing through a hollow core part of a coil, (b) a second partial core shaping step A material is pressed in a predetermined press direction to shape a second partial core which forms a magnetic path passing through an exterior of the hollow core part of the coil and which has a substantially flat pressed face orthogonal to the predetermined press direction, (c) a first partial core inserting-disposing step The first partial core is inserted in the hollow core part of the coil such that a pressed face of the first partial core is oriented orthogonal to a winding axis direction of the coil, and (d) a closed magnetic path forming step the second partial core is butted against the first partial core and disposed in the hollow core part of the coil to form the closed magnetic path.

In the step (d), the second partial core may be butted against the first partial core with the pressed face of the second partial core being oriented orthogonal to the pressed face of the first partial core.

In the step (b), the second partial core may be pressed and shaped to have a second magnetic path end face with a different area size from a first magnetic path end face of the first partial core which is disposed in a manner facing with the second magnetic path end face when the second partial core is butted against the first partial core.

In the step (b), the second partial core may be shaped such that the second magnetic path end face has a smaller area size than the first magnetic path end face and has a smaller dimension than the first magnetic path end face in a direction orthogonal to the pressed face of the second partial core.

In the step (d), a first gap may be provided between the first partial core and the second partial core such that the first magnetic path end face faces the second magnetic path end face with the first gap therebetween in the hollow core part of the coil.

In the step (a), the first partial core may be shaped such that a cross-sectional shape of the first partial core parallel to the pressed face of the first partial core becomes substantially similar to a cross-sectional shape of the hollow core part of the coil.

For example, the coil includes a pair of coils disposed side by side in a manner parallel to each other, the first partial core includes at least a pair of I-shaped cores, and the second partial core includes a pair of U-shaped cores having a first leg portion and a second leg portion disposed in a manner parallel to each other. In this case, in the step (c) at least one of the I-shaped cores is inserted and disposed in the hollow core part of each of the pair of coils. Moreover, in the step (d), the respective first leg portions of the pair of U-shaped cores and the respective second leg portions thereof are disposed so as to face with each other and to butt against each other through the I-shaped core inserted and disposed in the hollow core part of the coil.

In the step (c), a plurality of I-shaped cores may be inserted in the hollow core part of each coil in a manner disposed side by side in the winding axis direction. Moreover, in step (c), second gaps forming the closed magnetic path are each provided between the adjoining I-shaped cores.

According to the present invention, a reactor and a manufacturing method thereof are provided which enable press-molding by a die with a structure as simple as possible while eliminating the necessity of designing a clearance between the hollow core part of the coil and the partial core for avoiding burr.

DETAILED DESCRIPTION OF THE EMBODIMENTS

An explanation will now be given of a reactor and a manufacturing method thereof according to an embodiment of the present invention with reference to the accompanying drawings.

Figure 1:
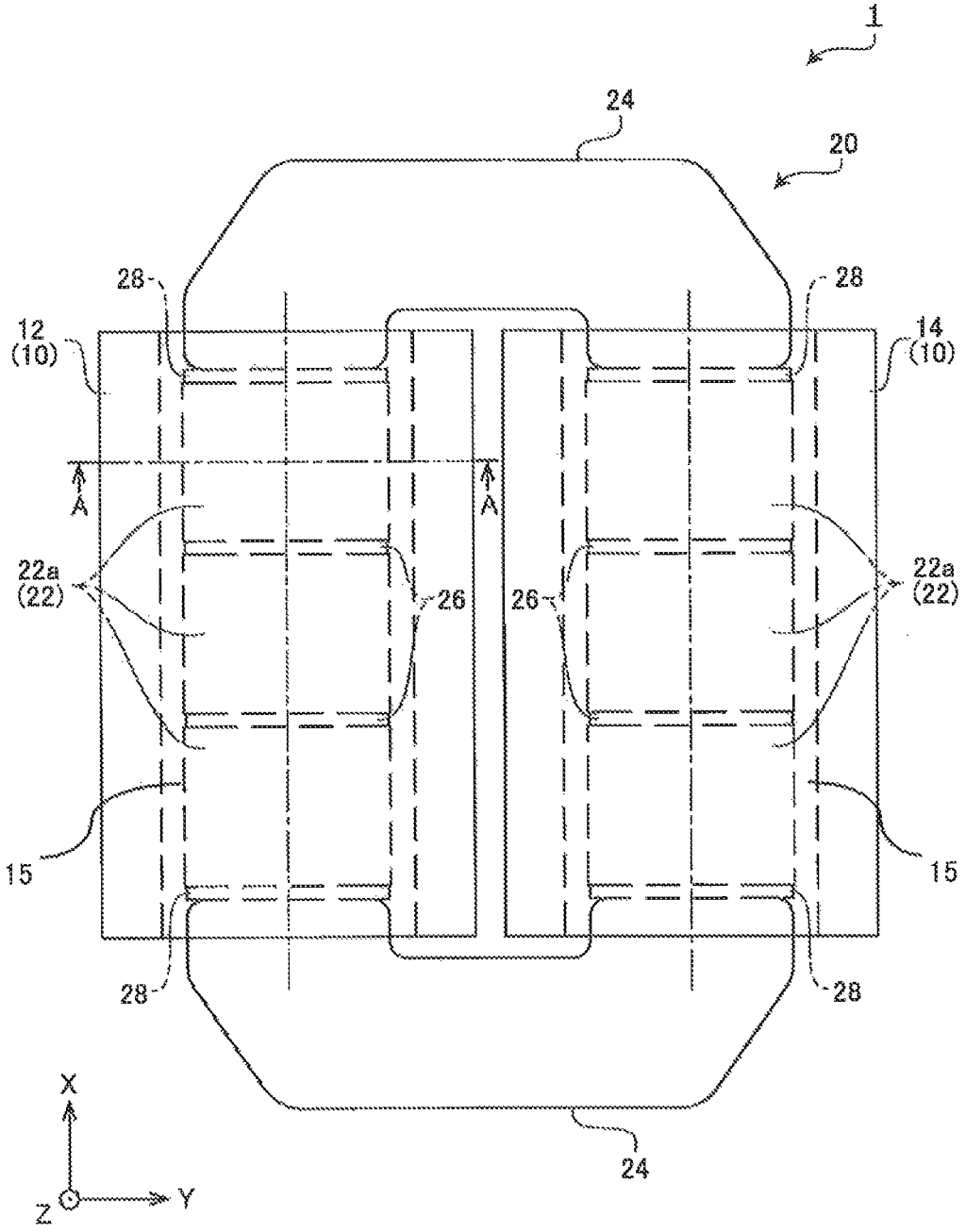
FIG. 1 is a plan view illustrating a reactor according to an embodiment of the present invention.
Figure 2:
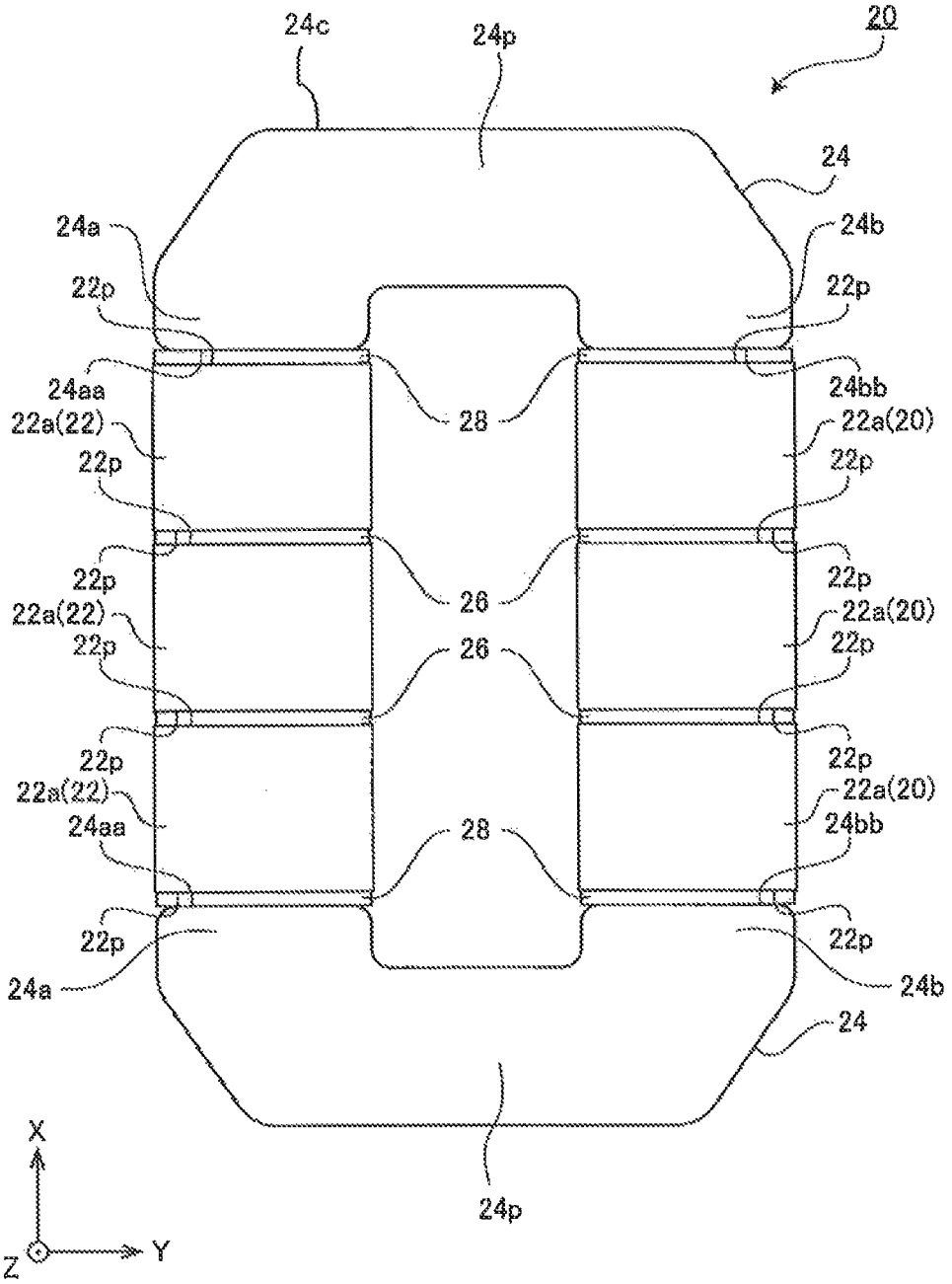
FIG. 2 is a plan view illustrating a core unit in solo provided in the reactor according to the embodiment of the present invention.
Figure 3:
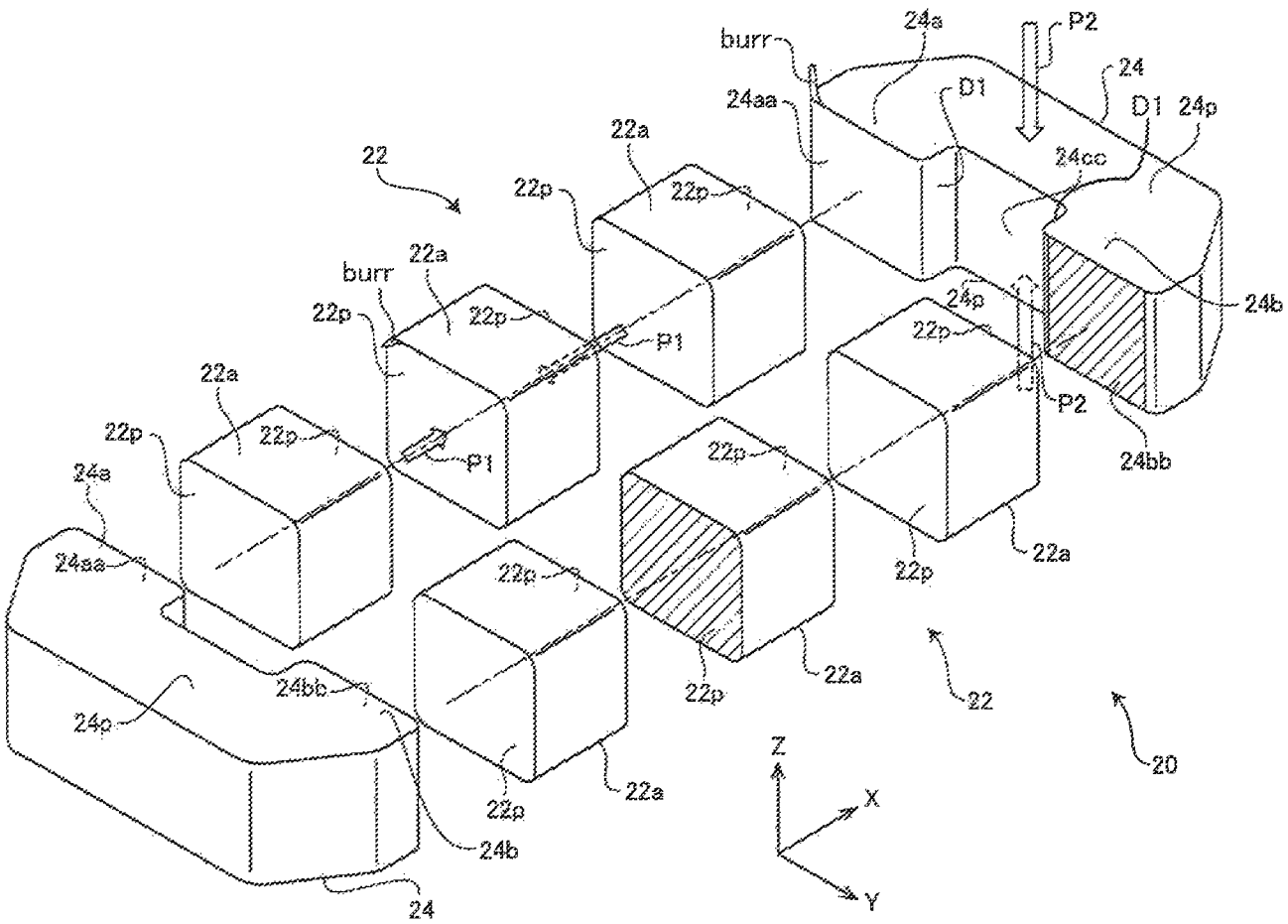
FIG. 3 is an exploded perspective view illustrating a plurality of partial cores configuring the core unit according to the embodiment of the present invention in an exploded manner.
Figure 4:
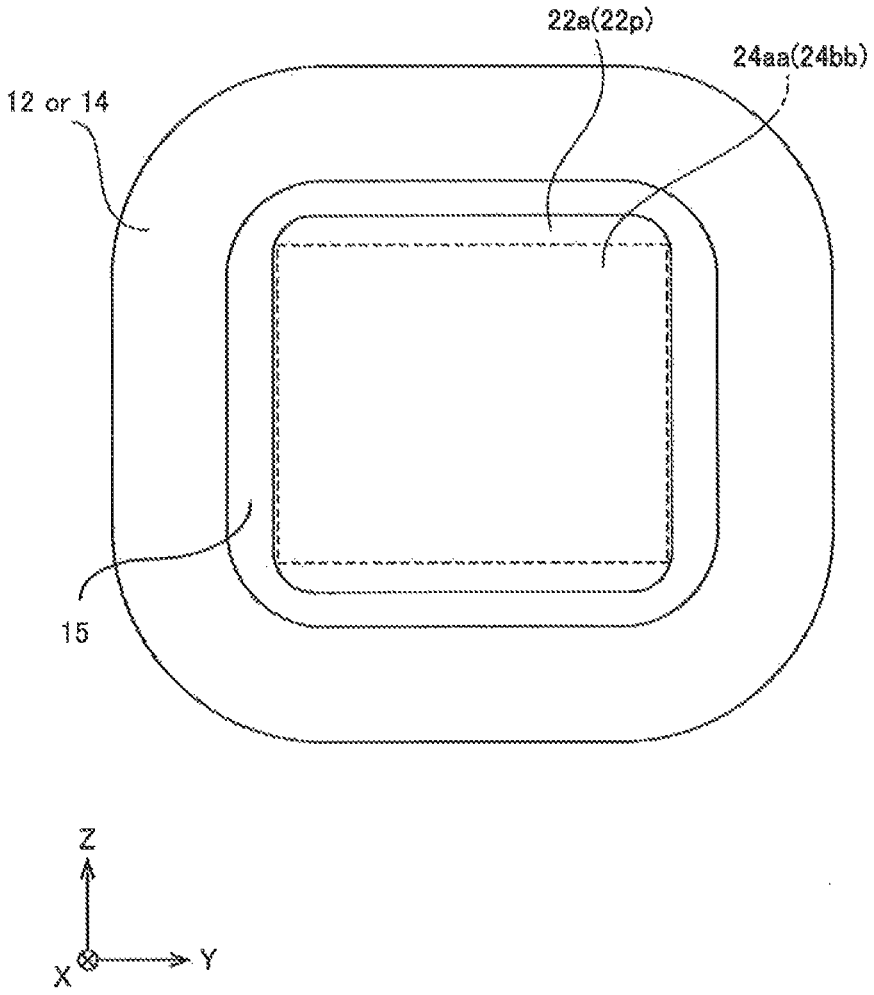
FIG. 4 is a diagram illustrating a cross section taken along a line A-A in FIG. 1.

FIG. 1 is a plan view illustrating a reactor 1 of this embodiment. The reactor 1 is, for example, a large-capacity reactor utilized for a drive system, etc., of a hybrid vehicle or an electric vehicle, and as illustrated in FIG. 1, includes a coil 10 and a core unit 20, FIG. 2 is a plan view illustrating the core unit 20 in solo. FIG. 3 is an exploded perspective view illustrating a plurality of partial cores configuring the core unit 20 in an exploded manner. FIG. 4 is a diagram illustrating a cross section taken along a line A-A in FIG. 1. In the following explanation, the vertical direction in FIG. 1 is defined as an X direction, the horizontal direction orthogonal to the vertical direction is defined as a Y direction, and a direction orthogonal to the vertical direction and the horizontal direction and perpendicular to the paper plane is defined as a Z direction. The reactor 1 can be disposed and directed in any direction when used.

The reactor 1 is fixed in an unillustrated heat-dissipation casing which is formed of a lightweight metal having a high thermal conductivity, e.g. an aluminum alloy, and having a retaining space formed in a substantially rectangular shape. A filler is filled between the reactor 1 and the heat-dissipation casing. A resin which is relatively soft and which has a high thermal conductivity is suitable as the filler in order to ensure the heat-dissipation performance of the reactor 1 and to suppress a transmission of vibration from the reactor 1 to the heat-dissipation casing.

The coil 10 employs a structure in which straight coils 12 and 14 with the same structure are disposed in parallel with each other and respective one ends thereof are coupled by an unillustrated wiring. For example, the straight coils 12 and 14 are each an edgewise coil having a rectangular wire folded at right angle at four locations in each turn and wound in a substantially square shape. As illustrated in FIG. 4, the straight coil 12 or 14 has a hollow core part 15 of which shape (hereinafter, referred to as a "hollowpart shape") is a substantially rectangular shape with rounded four corners appeared when the straight coil is cut in the direction orthogonal to the winding axis direction (X direction). Note that the terminals of each straight coil 12 or 14 coupled with a load are omitted in the figure in order to simplify the drawing.

As illustrated in FIGS. 1 to 3, the core unit 20 has a plurality of partial cores butted against one another, thereby forming a substantially annular closed magnetic path. The partial cores forming the closed magnetic path are a pair of I-shaped core groups 22 and a pair of U-shaped cores 24.

The I-shaped core group 22 includes three I-shaped cores 22*a* arranged in one direction, and the adjoining I-shaped cores 22*a* (adjoining end faces 22*p*) are respectively bonded and fixed together through a predetermined gap member 26 (unillustrated in FIG. 3).

The pair of I-shaped core groups 22 structured as explained above have respective I-shaped cores 22*a* inserted and disposed in the parts of the straight coils 12 and 14 in a manner directed in the winding axis direction (X direction). The gap member 26 is, for example, a tabular member formed of a nonmagnetic material (various ceramics like alumina or resins). The I-shaped core 22*a* is a magnetic powder compact formed of a powder magnetic core, but the powder magnetic core may be a ferrite magnetic core instead. The U-shaped core 24 is a partial core of substantially U-shape and includes a first leg portion 24*a* and a second leg portion 24*b* arranged in parallel with each other, and a connecting portion 24*c* connecting the first and the second leg portion 24*a* and 24*b*. The U-shaped core 24 is formed of the same material as that of the I-shaped core 22*a*. The pair of U-shaped cores 24 are disposed in such a way that the respective first leg portions 24*a* and the respective second leg portions 24*b* face with each other via the I-shaped core group 22. That is, the core unit 20 has the respective leg portions of the pair of U-shaped cores 24 butted against each other through the I-shaped core group 22, thereby forming a substantially annular closed magnetic path having each partial core as a magnetic path.

A leg-portion end face 24*aa* of the first leg portion 24*a* and the end face 22*p* of the I-shaped core 22*a* facing with the leg-portion end face 24*aa* are bonded and fixed together through a gap member 28 (unillustrated in FIG. 3). Moreover, a leg-portion end face 24*bb* of the second leg portion 24*b* and the end face 22*p* facing with the leg-portion end face 24*bb* are bonded and fixed together through the gap member 28. Those gap members 28, that are, the gaps between the leg-portion end face 24*aa* or the leg-portion end face 24*bb* and the end face 22*p* are disposed in the hollow core part 15 of the straight coil 12 or 14.

In this embodiment, the gap members 26 or 28 are present in all magnetic paths between the adjoining partial cores. Since all gap members 26 or 28 are disposed in the hollow core part 15 of the straight coil 12 or 14, a loss of the magnetic flux due to a leakage can be suppressed when the magnetic flux flows into the adjoining partial core.

Figure 5A:
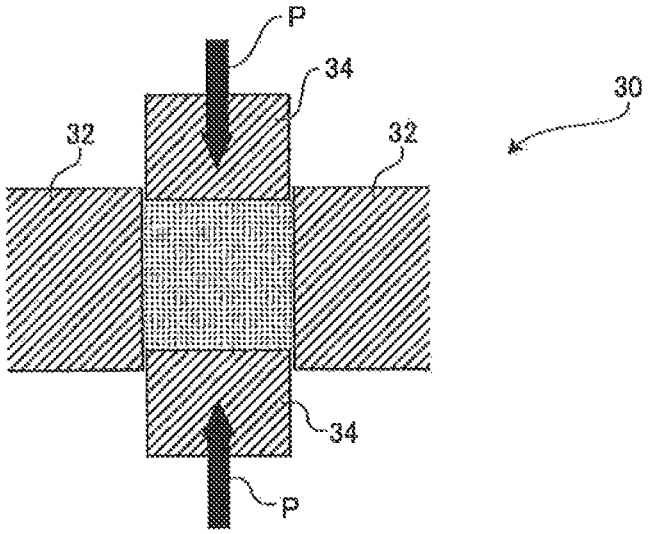
FIGS. 5A-5C are diagrams each illustrating an outline of a pressing process of an I-shaped core and a U-shaped core by a press shaping die.
Figure 5B:
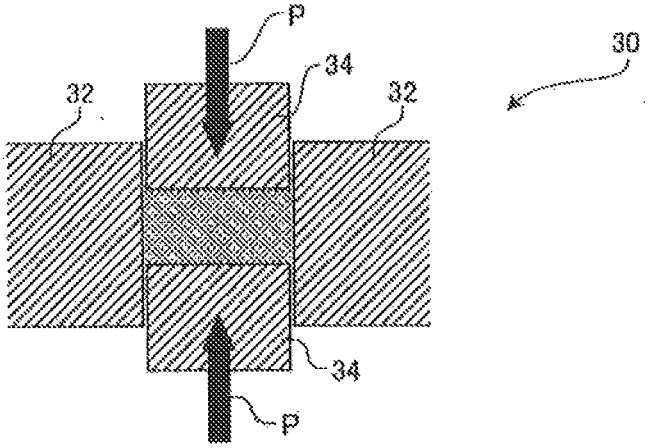
Figure 5C:
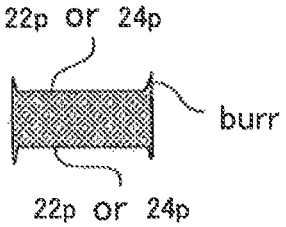

FIGS. 5A to 5C are diagrams illustrating an outline of the pressing of the I-shaped core 22*a* and the U-shaped core 24 by a press-molding die. As illustrated in FIG. 5A, a press-molding die 30 includes a fixed die 32 that surrounds the horizontal direction of a work-piece, and a pair of top and bottom movable dies 34 that respectively seal the top and bottom openings of the fixed die 32 Magnetic powders are put in a cavity defined by the fixed die 32 and the top and the bottom movable dies 34. After the magnetic powders are put in, the top and the bottom movable dies 34 are moved relative to each other in a direction coming close to each other (the direction of an arrow P), as illustrated in FIG. 5B, and thus the magnetic powders in the cavity are compressed and pressed, and thus the I-shaped core 22*a* or the U-shaped core 24 is formed.

The movable dies 34 are fitted to the fixed die 32 by, for example, loose fitting since the movable dies 34 slide in the vertical direction in the fixed die 32. Accordingly, there is an extremely tiny clearance between the side wall of the fixed die 32 and the pressing face of the movable die 34. Even though such a clearance is extremely tiny, the magnetic powders enter in such a clearance at the time of compression and pressing, and as illustrated in FIG. 5C, the magnetic powders having entered such a clearance remain as burr on the end face (pressed face) 22*p* of the I-shaped core 22*a* or a pressed face 24*p* of the U-shaped core 24. The pressed face 22*p* and 24*p* are each a surface of the I-shaped core 22*a* and the U-shaped core 24 pressed by the pressing face of the movable die 34, and the term burr in this embodiment mainly means an unnecessary objects running in the direction orthogonal to the press face 22*p* and 24*p*.

Figure 6A:
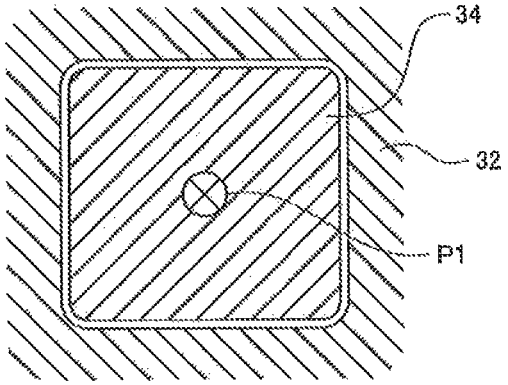
FIG. 6A is a diagram illustrating a press shaping die for the I-shaped core as viewed from the top.

FIG. 6A is a diagram illustrating a press-molding die 30 for the I-shaped core 22*a* as viewed from the top. It should be noted that in FIG. 6A and in FIG. 6B to be discussed later, a clearance between the fixed die 32 and the movable die 34 is illustrated in exaggerated manner for the purpose of explanation. As illustrated in FIG. 6A, the fixed die 32 for the I-shaped core 22*a* is formed in a substantially rectangular aperture shape having four rounded corners. Moreover, the movable dies 34 for the I-shaped core 22*a* are each formed in a substantially rectangular columnar shape having four rounded corners, and are capable of sealing respective top and bottom rectangular openings formed in the fixed die 32. However, there is an extremely tiny clearance between the side face of the fixed die 32 and the pressing face of the movable die 34. Accordingly, when the top and the bottom movable dies 34 are moved relative to each other in the direction of an arrow P1 (see FIGS. 3 and 6A) and the magnetic powders are compressed and pressed, the magnetic powders having entered in the clearance remain as burr on the pressed face 22*p* of the I-shaped core 22*a*. In FIG. 5C, only one burr left on the pressed face 22*p* is illustrated for simplifying the illustration.

As illustrated in FIG. 3, the I-shaped core 22*a* is inserted and disposed in the hollow core part 15 of the straight coil 12 or 14 such that the pressed face 22*p* is oriented orthogonal to the winding axis direction (X direction) of the coil 12 or 14. As a result, the burr on the pressed face 22*p* runs mainly in the winding axis direction. Accordingly, it is unnecessary to set a clearance between the I-shaped core 22*a* and the hollow core part 15 for avoiding a contact of the burr against the coil. This makes it possible to design a large cross-sectional area of the I-shaped core 22*a*, which is advantageous for a high-inductance designing. In other words, since a clearance for avoiding a contact of the burr against the coil is unnecessary, the hollow core part 15 of the coil can be made small, which is advantageous for a downsizing design of the coil.

Moreover, as illustrated in FIG. 4, the I-shaped core 22*a* is designed to have a similar cross-sectional shape to the shape of the hollow core part 15 of the straight coil 12 or 14. In other words, a cross-sectional shape of the I-shaped core 22*a* orthogonal to the winding axis direction is made substantially similar to a shape of the hollow core part of the coil which appears when the coil is cut in a direction orthogonal to the winding axis direction. Accordingly, the clearance between the I-shaped core 22*a* and the hollow core part 15 can be made small, and the large cross-sectional area of the I-shaped core 22*a* can be designed.

More specifically, as illustrated in FIG. 4, the I-shaped core 22*a* is designed to have a substantially rectangular cross-section with four rounded corners which is slightly offset from the whole hollow shape of the hollow core part 15. It is unnecessary to design the cross-sectional shape of the I-shaped core 22*a* so as to have perfect similarity to the hollow shape of the straight coil 12 or 14. For example, the four corners of the substantially rectangular cross-section of the I-shaped core 22*a* illustrated in FIG. 4 can be formed as a curved face instead of the rounded face. By this way, the clearance between the I-shaped core 22*a* and the hollow core part 15 can be made small, and the large cross-sectional area of the I-shaped core 22*a* can be designed.

Figure 6B:
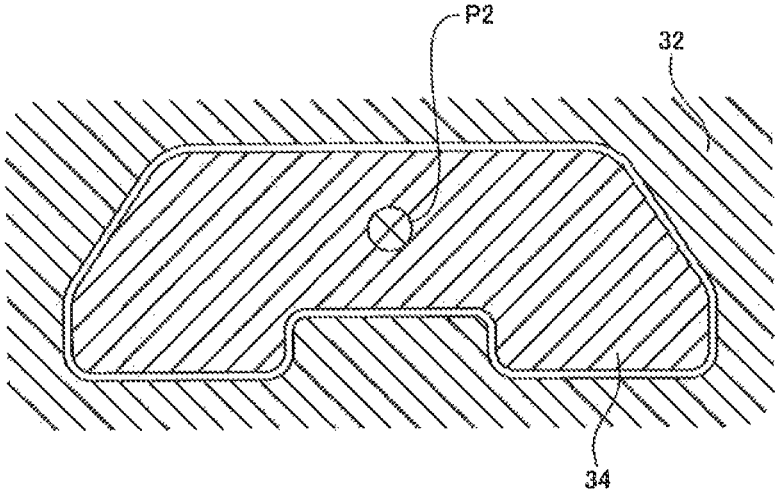
FIG. 6B is a diagram illustrating a press shaping die for the U-shaped core as viewed from the top.

FIG. 6B is a diagram illustrating a press-molding die 30 for the U-shaped core 24 as viewed from the top. As illustrated in FIG. 6B, a fixed die 32 for the U-shaped core 24 is formed in a U-shaped aperture shape having respective rounded corners. Moreover, movable dies 34 for the U-shaped core 24 are each foil led in a U-shaped polygonal column shape having respective rounded corners, and are capable of sealing respective vertical U-shaped openings formed in the fixed die 32. In the press-molding die 30 for the U-shaped core 24, there is also an extremely tiny clearance between the side wall of the fixed die 32 and the pressing faces of the movable dies 34. Hence, when the top and the bottom movable dies 34 are moved relative to each other in the direction of an arrow P2 (see FIGS. 3 and 6B) and the magnetic powders are compressed and pressed, the magnetic powders having entered the clearance remain as burr on the pressed face 24*p* of the U-shaped core 24. In FIG. 5C, only one burr left on the pressed face 24*p* is illustrated in order to simplify the illustration.

As illustrated in FIG. 3, the U-shaped core 24 has two large step portions D1 on a plane orthogonal to the winding axis direction (X direction). One step portion D1 is formed since the height in the X direction of an end face 24*aa* of the first leg portion 24*a* and that of the side face 24*cc* of the connecting portion 24*c* differ from each other. Similarly, other step portion D1 is formed since the height in the X direction of an end face 24*bb* and that of the side face 24*cc* of the connecting portion 24*c* differ from each other, (step portions D1 are illustrated in only FIG. 3 for the matter of simplification). In the conventional technology, when the U-shaped core 24 is compressed and pressed by a pair of movable dies that can move relative to each other in the lengthwise direction (X direction) of the leg portion, it is necessary to adopt a multi-stage press molding die which is, for example, complex and takes costs. In contrast, according to this embodiment, the pair of movable dies 34 that can move relative to each other in the direction of the arrow P2 (Z direction), that is orthogonal to the winding axis direction (X direction), is used for compressing and pressing the magnetic powders.

In either one of the I-shaped core 22*a* and the U-shaped core 24, the thickness of the powder compact pressed between the top and the bottom movable dies 34 becomes uniform in the pressing direction and has no step portion, i.e., flat in this direction. Therefore, a multi-stage press molding die which is complex and takes costs becomes unnecessary. That is, the I-shaped core 22*a* and the U-shaped core 24 can be pressed and formed by a die with a simple structure. This is advantageous from the standpoint of costs (e.g., initial costs and the maintenance costs of the die).

As illustrated in FIG. 3, the U-shaped core 24 has the pressed face 24*p* disposed in a manner parallel with the winding axis direction (X direction) so that the remaining burr run mainly in the direction (Z direction) orthogonal to the winding axis direction. In other words, the pressed face 24*p* and the pressed face 22*p* of the I-shaped core 22*a* are disposed in directions orthogonal to each other. Here, each tip of the first leg portion 24*a* or the second leg portion 24*b* is inserted and disposed in the hollow core part 15 of the straight coil 12 or 14, and thus there is a concern that the burr remaining near the leg-portion end faces 24*aa* and 24*bb* may damage the insulation layer of the straight coil 12 or 14. Hence, as illustrated in FIG. 4, the U-shaped core 24 has the height dimension (Z direction) of the leg-portion end faces 24*aa* and 24*bb* designed so as to be shorter than the height dimension of the substantially rectangular cross-section (or pressed face 22*p*) of the I-shaped core 22*a*, and thus a sufficient clearance for avoiding the burr is ensured between the respective tips of the first leg portion 24*a*, the second leg portion 24*b* and the hollow core part 15.

In this embodiment, the planar shape of the leg-portion end faces 24*aa* and 24*bb* differs from the planar shape of the pressed face 22*p*. That is, the area size each of the leg-potion end faces 24*aa* and 24*bb* is smaller than the area size of the pressed face 22*p*. Moreover, the cross-sectional area size of the U-shaped core 24 is smaller than the cross-sectional area size of the I-shaped core 22*a*.

In a case the cross-sectional area size and planar shape, etc., of adjoining partial cores differ as explained above, a reduction of the inductance is concerned due to, for example, the leakage of the magnetic flux. However, it is appropriate if the cross-sectional area of the U-shaped core 24 and the planar shape and area of the leg-portion end faces 24*aa* and 24*bb* be designed in consideration of a relationship between the DC superimpose characteristic necessary for the specification and the reduction of the DC superimpose characteristic due to magnetic saturation, and the differences in the cross-sectional area of the I-shaped core 22*a* and the planar shape and area of the pressed face 22*p* are not always a problem. For example, the U-shaped core 24 is one obtained by eliminating a part (where magnetic fluxes hardly pass through) of a U-shaped core model having the same cross-sectional area as that of the I-shaped core 22*a*, and thus it is designed so that the inductance does not decrease substantially. In this case, the superimposition of the U-shaped core 24 is reduced, contributing to the weight saving of the reactor 1.

The above explanation was for an example embodiment of the present invention. The embodiment of the present invention is not limited to the above explanation, and can be changed as needed within the scope of the technical thought defined in the appended claims. For example, in the above-explained embodiment, the gap members 26 or 28 are bonded and fixed at all magnetic paths between the adjoining partial cores, but in another embodiment, air gaps may be employed instead of such gap members.

Figure 7:
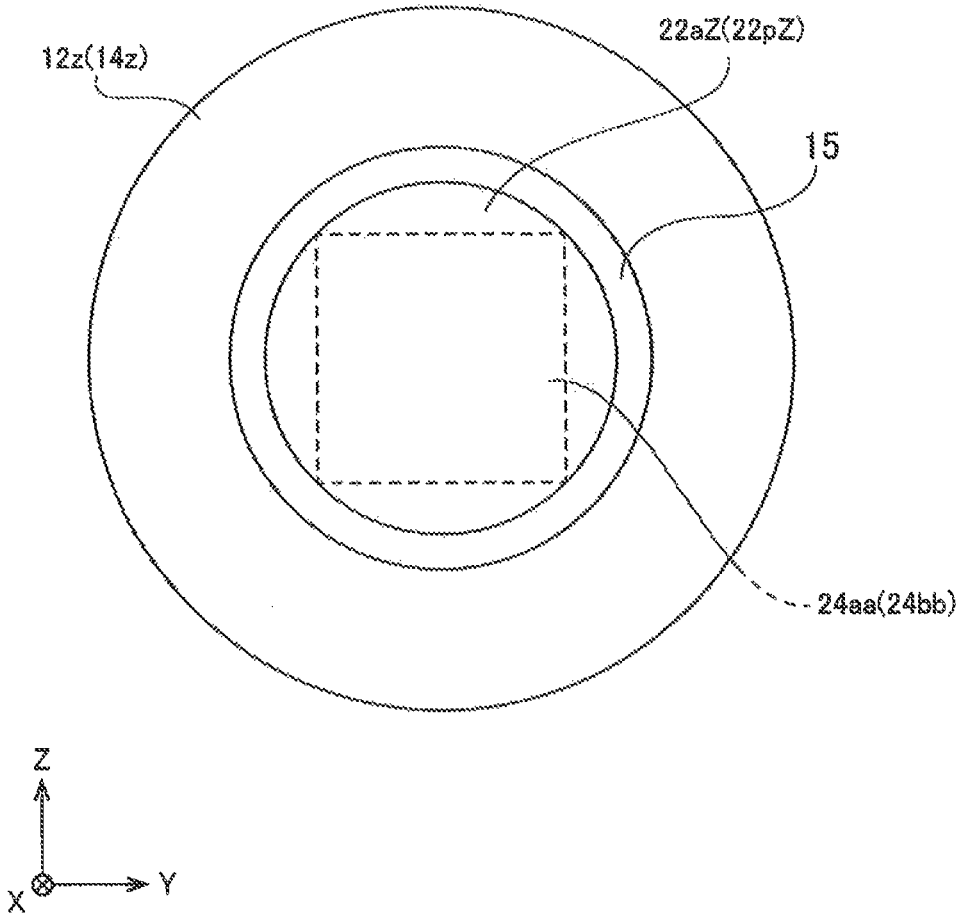
FIG. 7 is a cross-sectional view of a straight core part and an I-shaped core according to a modified example of the embodiment of the present invention.

FIG. 7 is a cross-sectional view (corresponding to a cross-section taken along the line A-A in FIG. 1) of a straight coil 12*z* (or 14*z*) and an I-shaped core 22*a*Z of the reactor 1 according to a modified example of the above-explained embodiment. As illustrated in FIG. 7, the straight coil 12*z* or 14*z* is an edgewise coil having a rectangular wire wound in a spiral manner and having an annular cross-section. Moreover, the I-shaped core 22*a*Z is in a columnar shape having a circular cross-section similar to the hollow (circular shape) of the straight coil 12*z* and 14*z*. Hence, according to this modified example, also, the clearance between the hollow core part 15 and the I-shaped core 22*a*Z can be as small as possible, and thus the cross-sectional area of the I-shaped core 22*a*Z can be designed largely.

Figure 8A:
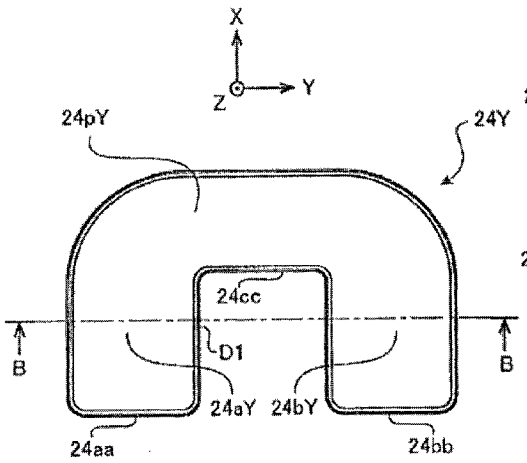
FIGS. 8A-8E are diagrams each illustrating a structure of a U-shaped core according to another modified example of the embodiment of the present invention.
Figure 8B:
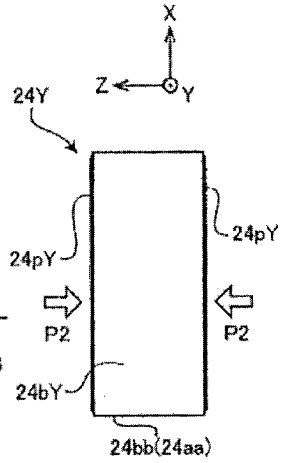
Figure 8C:
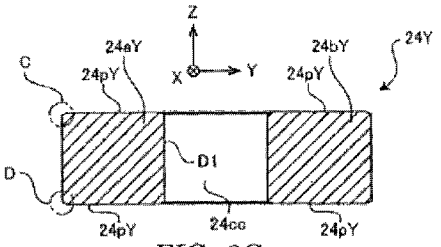
Figure 8D:
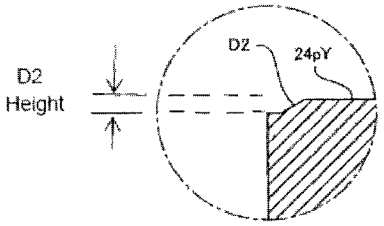
Figure 8E:
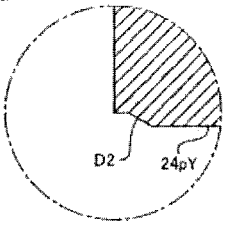

Moreover, according to the above-explained embodiment, a thickness of the U-shaped core 24 in the direction of the arrow P2 (Z direction) that is a pressing direction is uniform and has no step portion. Accordingly, it can be pressed and molded by a die with a simple structure. Meanwhile, depending on the type of the core, the U-shaped core has a step portion in the Z direction. FIGS. 8A to 8E are diagrams illustrating a U-shaped core according to another modified example of the reactor 1 of the embodiment and a structure of a U-shaped core 24Y having a step portion in the Z direction. More specifically, FIGS. 8A and 8B are a plan view of the U-shaped core 24Y according to another modified example, and a side view thereof, respectively. FIG. 8C is a cross-sectional view taken along a line B-B in FIG. 8A. FIGS. 8D and 8E are enlarged cross-sectional view illustrating areas C and D in FIG. 8C, respectively.

As illustrated in FIGS. 8A to 8E, a pressed face 24*p*Y of the U-shaped core 24Y is provided with a step portion D2 across the whole edge thereof. By this step portion D2, the pressed face 24 *p*Y has an edge lower than the rest of the face. That is to say, the U-shaped core 24Y of this another modified example has step portions not only in the X direction but also the Z direction, that is, the steps D1 and D2. However, the height of the step portion D2 in the Z direction is remarkably smaller than the height of the step portions D1 in the X direction, and is, for example, equal to or smaller than 5% relative to the thickness of the U-shaped core 24Y in the Z direction (when thickness is 20 mm, equal to or smaller than 1 mm, and when thickness is 40 mm, equal to or smaller than 2 mm). Such a small step equal to or smaller than 5% (e.g., equal to or larger than 1 mm and equal to or smaller than 2 mm) relative to the thickness does not make the structure of a die complex. Therefore, the U-shaped core 24Y of another modified example is compressed and pressed in the direction of the arrow P2 (Z direction) as similar to the U-shaped core 24 of the above embodiment.

That is, also in another modified example, simplification of the structure of a die is mainly focused without taking the press direction (X direction) of the I-shaped core 22*a* into consideration, and the die of the U-shaped core 24Y is designed. In the U-shaped core 24Y of another modified example, the lower portion at the edge has a high surface pressure at the time of compression and molding, the compression density becomes high, thereby enhancing the strength. Hence, according to another modified example, breaking and chipping of the edge is further suppressed.

Here, according to the present application, "substantially flat plane" includes a pressed face having a small step portion which does not substantially make the structure of a die complex (e.g., the pressed surface having a step portion smaller than 5% (e.g., equal to or larger than 1 mm and equal to or smaller than 2 mm) to the thickness of the core).

Figure 9A:
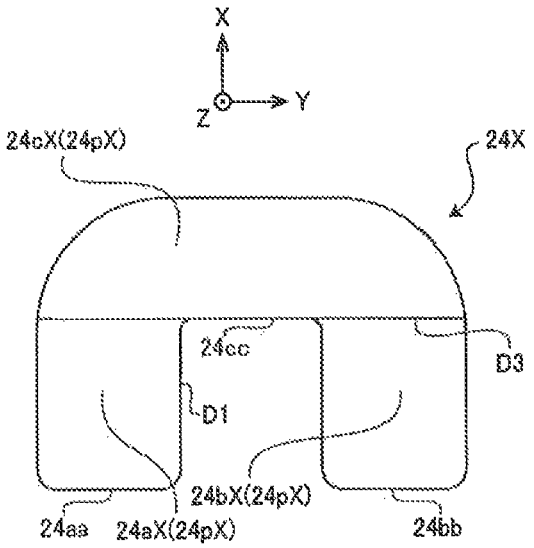
FIGS. 9A-9B are diagrams each illustrating a structure of a U-shaped core according to the other modified example of the embodiment of the present invention.
Figure 9B:
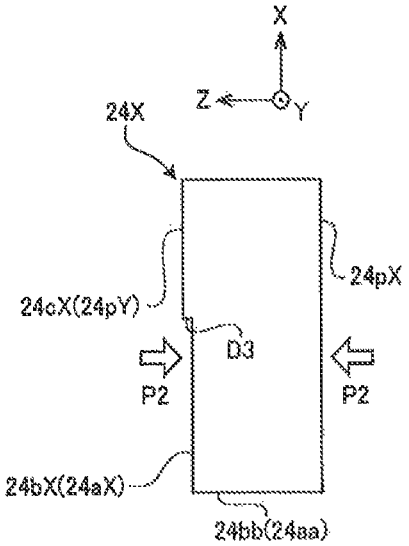

FIGS. 9A and 9B illustrate a structure of a U-shaped core 24X which is a U-shaped core of the reactor 1 according to the other modified example of the above-explained embodiment and which has a step portion also in the Z direction. More specifically, FIGS. 9A and 9B are a plan view of the U-shaped core 24X of the other modified example and a side view thereof, respectively. As illustrated in FIGS. 9A and 95, a pressed face 24*p*X of the U-shaped core 24X includes pressed faces 24*a*X and 24*b*X on respective leg portions, and a pressed face 24*c*X on an interconnection portion that interconnects the respective leg portions together, and step D3 is formed between the pressed face 24*a*X, 24*b*X and the pressed face 24*c*X. The step height of the step D3 in the Z direction is suppressed to be a height that does not substantially make the structure of a die complex (e.g., equal to or smaller than 5% relative to the thickness of the U-shaped core 24X in the Z direction (e.g., equal to or larger than 1 mm and equal to or smaller than 2 mm)) like the modified example illustrated in FIGS. 8A to 8E. According to the modified example illustrated in FIGS. 9A and 9B, the cross-sectional area of, for example, the interconnection portion of the U-shaped core 24X can be increased by adding the step portion D3, and thus it is advantageous for suppressing a reduction of the DC superimpose characteristic by magnetic saturation. Although in the modified example illustrated in FIGS. 9A and 9B, the step portion D3 is formed at the one pressed face 24*p*X, the step portion D3 may be added to both pressed faces 24*p*X.

What is claimed is:

1. A reactor, comprising:

a coil including a hollow core-insertion part; and a core unit comprising a plurality of partial cores butted one another to form a closed magnetic path, and partially inserted and disposed in the hollow core-insertion part of the coil, the plurality of partial cores comprising a first partial core which forms a magnetic path passing through the hollow core-insertion part of the coil and has a pressed face surface pressed at a time of press-shaping; and a second partial core which forms a magnetic path passing through an exterior of the hollow core-insertion part of the coil and has a pressed face surface pressed at a time of press-shaping, the first partial core inserted and disposed in the hollow core-insertion part of the coil such that the pressed face surface of the first partial core is oriented orthogonal to a winding axis direction of the coil, the second partial core butted against the first partial core and disposed such that the pressed face surface of the second partial core is oriented orthogonal to the pressed face surface of the first partial core, and the pressed face surface of the second partial core being a substantially flat plane, wherein the first partial core comprises a first magnetic path end face orthogonal to the winding axis direction, the second partial core comprises a second magnetic path end face orthogonal to the winding axis direction, and the first magnetic path end face and the second magnetic path end face are disposed so as to face each other, and to have different area sizes between each other.

2. The reactor according to claim 1, wherein the second magnetic path end face has a smaller area size than the area size of the first magnetic path end face, and has a smaller dimension than the first magnetic path end face in a direction orthogonal to the pressed face surface of the second partial core.

3. The reactor according to claim 1, wherein the first magnetic path end face and the second magnetic path end face are disposed in the hollow core-insertion part of the coil so as to face with each other with a first gap therebetween.

4. The reactor according to claim 1, wherein a cross-sectional shape of the first partial core orthogonal to the winding axis direction is substantially similar to a cross-sectional shape of the hollow core-insertion part of the coil orthogonal to the winding axis direction.

5. The reactor according to claim 1, wherein the coil comprises a pair of coils disposed side by side in a parallel manner, the core unit comprises:

at least a pair of I-shaped cores each inserted and disposed in the hollow core-insertion part of each of the pair of coils; and a pair of U-shaped cores each comprising a first leg portion and second leg portion disposed in parallel with each other, and being disposed in such a way that the respective first leg portions and the respective second leg portions face with each other, the respective first leg portions of the pair of U-shaped cores and the respective second leg portions thereof are disposed so as to be butted with each other through the I-shaped core inserted and disposed in the hollow core-insertion part of the coil to form a substantially annular closed magnetic path, the I-shaped core is the first partial core, and the U-shaped core is the second partial core.

6. The reactor according to claim 5, wherein the I-shaped core comprises a plurality of I-shaped cores inserted in the hollow core-insertion part of each coil and disposed side by side in the winding axis direction.

7. The reactor according to claim 6, further comprising second gaps each present between the adjoining I-shaped cores so as to form the closed magnetic path.

8. The reactor according to claim 7, further comprising first gaps present between the respective first and second leg portions of the U-shaped core and the I-shaped cores, wherein all of the first and the second gaps are disposed in the hollow core-insertion part of the coil.

9. A reactor comprising:

a coil including a hollow core-insertion part; and a core unit comprising a plurality of partial cores butted one another to form a closed magnetic path, and partially inserted and disposed in the hollow core-insertion part of the coil, the plurality of partial cores comprising a first partial core which forms a magnetic path passing through the hollow core-insertion part of the coil and has a pressed face surface pressed at a time of press-shaping; and a second partial core which forms a magnetic path passing through an exterior of the hollow core-insertion part of the coil and has a pressed face surface pressed at a time of press-shaping, the first partial core being inserted and disposed in the hollow core-insertion part of the coil with the pressed face surface of the first partial core being oriented orthogonal to a winding axis direction of the coil, the second partial core being butted against the first partial core and disposed such that the pressed surface face of the second partial core is oriented orthogonal to the pressed face surfaces of the first partial core, and the pressed face surface of the second partial core being a substantially flat plane wherein one of the pressed face surface of the plurality of partial cores and the pressed face surface of one of the pressed face surface of the first partial core and the second partial core has a burr extending outward from a substantially flat plane of the pressed face surface.

10. The reactor according to claim 1, wherein the pressed face surface of the second partial core is provided with a step portion across a whole edge of the pressed face of which height is equal to or smaller than 1 mm.

11. The reactor according to claim 1, wherein the pressed face surface of the second partial core is provided with a step portion with a height equal to or smaller than 5% relative to a thickness of the second partial core.

* * * * *